US007237456B2

(12) United States Patent
Neves

(10) Patent No.: US 7,237,456 B2
(45) Date of Patent: Jul. 3, 2007

(54) POWER TONG WITH REDUCED DIE MARKINGS

(75) Inventor: Billy W. Neves, Odessa, TX (US)

(73) Assignee: Eckel Manufacturing Co., Inc., Odessa, TX (US)

( * ) Notice: Subject to any disclaimer, the term of this patent is extended or adjusted under 35 U.S.C. 154(b) by 33 days.

(21) Appl. No.: 10/835,370

(22) Filed: Apr. 29, 2004

(65) Prior Publication Data

US 2005/0241442 A1 Nov. 3, 2005

(51) Int. Cl.
*B25B 13/50* (2006.01)

(52) U.S. Cl. ..... 81/57.18; 81/57.34

(58) Field of Classification Search ..... 81/57.15, 81/57.16, 57.18, 57.21, 57.33, 57.34
See application file for complete search history.

(56) References Cited

U.S. PATENT DOCUMENTS 4,084,453 A 4/1978 Eckel
4,089,240 A * 5/1978 Eckel ..... 81/57.18
4,291,598 A * 9/1981 Cherry ..... 81/57.15
4,357,843 A * 11/1982 Peck et al. ..... 81/57.16
4,986,146 A * 1/1991 Buck ..... 81/57.18
5,172,613 A * 12/1992 Wesch, Jr. ..... 81/57.33
6,050,156 A * 4/2000 Buck ..... 81/57.15
2002/0121160 A1* 9/2002 Bangert ..... 81/57.5

* cited by examiner

*Primary Examiner*—D. S. Meislin
(74) *Attorney, Agent, or Firm*—Browning Bushman P.C.

(57) ABSTRACT

A power tong 10 rotates a tubular during makeup or breakout of the threaded connection. A tong frame 12, a rotatable ring 20, and a cage plate assembly may each have an open throat for receiving the tubular. A plurality of dies 32 are preferentially manufactured from aluminum, and each have a knurled surface for engaging the tubular. A fluid powered cylinder 54 increases tension between the brake band 50 and the cage plate assembly. Neutral cam portions of the cam surface one positioned radially outward substantially from the makeup and breakout cam portions.

14 Claims, 4 Drawing Sheets

POWER TONG WITH REDUCED DIE MARKINGS

FIELD OF INVENTION

The present invention relates to power tongs of the type used to make up and break out oilfield tubulars. More particularly, this invention relates to a power tong designed to minimize marking of a tubular by the tong dies, which is particularly important for chrome plated tubulars.

BACKGROUND OF THE INVENTION

Hundreds of patents have been granted for power tongs designed to make up and break out oilfield tubulars. Most commercially successful power tongs have an open throat so that the power tong can be moved laterally on or off the tubular. Power tongs with closed throats have utility for certain applications, but generally are not as widely used as rig power tongs for connecting and disconnecting tubulars as they are run into and out of the well.

Chrome plated tubulars are being increasingly popular due to the increased protection provided by highly corrosive downhole environments. The advantage of plating the tubular is substantially sacrificed, however, if the tong dies which make up the connection "mark" the OD of the tubular to the extent that the chrome plating is pierced. When the tubular is then placed downhole, corrosive fluids may act on this damaged area, thereby corroding the steel tubular, and may spread as the corrosive fluids get under the chrome layer.

In an attempt to minimize marking of chrome plated tubulars, some power tongs have employed aluminum dies. Aluminum substantially reduces markings since the aluminum material is softer than both the chrome and the oilfield tubular. The problem with this practice is that the aluminum dies, which reduce marking by providing relatively smooth biting surface, do not adequately grip the tubular to perform the makeup or breakout operation. Accordingly, aluminum dies in power tongs commonly slide on the tubular surface during the makeup or breakout operation, which then further scrapes and damages the chrome plating on the oilfield tubular.

U.S. Pat. No. 4,084,453 discloses a power tong with a rotary cage plate and a rotary gear with a relatively low cam angle for cooperation with gripping heads. This tong, which performs satisfactory for many applications, does not provide the minimum marking necessary for use on chrome plated oilfield tubulars.

The disadvantages of the prior art are overcome by the present invention, and an improved power tong as hereinafter disclosed, which is particularly suitable for taking up and breaking out chrome plated oilfield tubulars.

SUMMARY OF INVENTION

In one embodiment, a power tong for rotating a tubular to make up or break out a threaded connection comprises an open throat tong frame, and partial ring rotatably mounted on the frame about a center of rotation, with the ring defining a plurality of cam surfaces on an interior surface of the ring, with each cam surface having a neutral cam portion, a makeup cam portion and a breakout cam portion. A cage plate is provided rotatable with the ring, and a plurality of dies are supported on the cage plate and adapted to move radially in response to movement of the dies along with the cam surfaces. The drive mechanism is provided for rotating the ring, the cage plate assembly and the dies to rotate the tubular. An arcuate brake band is provided for frictional engagement with the cage plate assembly, and a brake band fluid powered cylinder selectively increases frictional forces between the brake band and the cage plate assembly.

In another embodiment, the power tong includes a pair of dies each supported on the cage plate assembly and adapted to move radially in response to movement of the dies along the cam surfaces. A neutral cam portion of the cam surface is spaced radially outward from an imaginary circle intersecting radially inward edges of the open throat of the ring gear by a spacing of at least 25% of the imaginary circle diameter. Each of the makeup cam portion and the breakout cam portion of the partial ring preferably have a cam angle less than about ¾°.

In still another embodiment, the power tong includes an arcuate brake band for frictional engagement with a cage plate assembly, with a brake band having an axially extending height of at least 35% of the width of the open throat of the cage plate. An arcuate plate extending upward from the cage plate is provided for engagement with the brake band.

A feature of the invention is that the ring and cage plate assembly each have an open throat for moving the tubular laterally into and out of the central opening in the tong frame.

As another feature of the invention, the dies are formed from aluminum and have a knurled surface, preferably with the depth of less than 0.015 inches. Each of the dies engages a tubular over a circumferential length of at least 170°.

As another feature of the invention that the neutral cam portion of the cam surface is spaced radially outward from an imaginary circle intersecting radially inward edges of the throat of the ring plate by a spacing of at least 25% of the imaginary circle diameter. Each of the cam makeup and breakout surfaces of the partial ring have a cam angle less than about ¾°.

Another feature of the invention is that the brake band has an axially extending height of at least 35% of the width of the open throat of the cage plate assembly. An arcuate plate extends upward from the cage plate for engagement with the brake band.

These and further features and advantages of the present invention will become apparent from the following detailed description, wherein reference is made to the figures in the accompanying drawings.

DETAILED DESCRIPTION OF PREFERRED EMBODIMENTS

Figure 1:
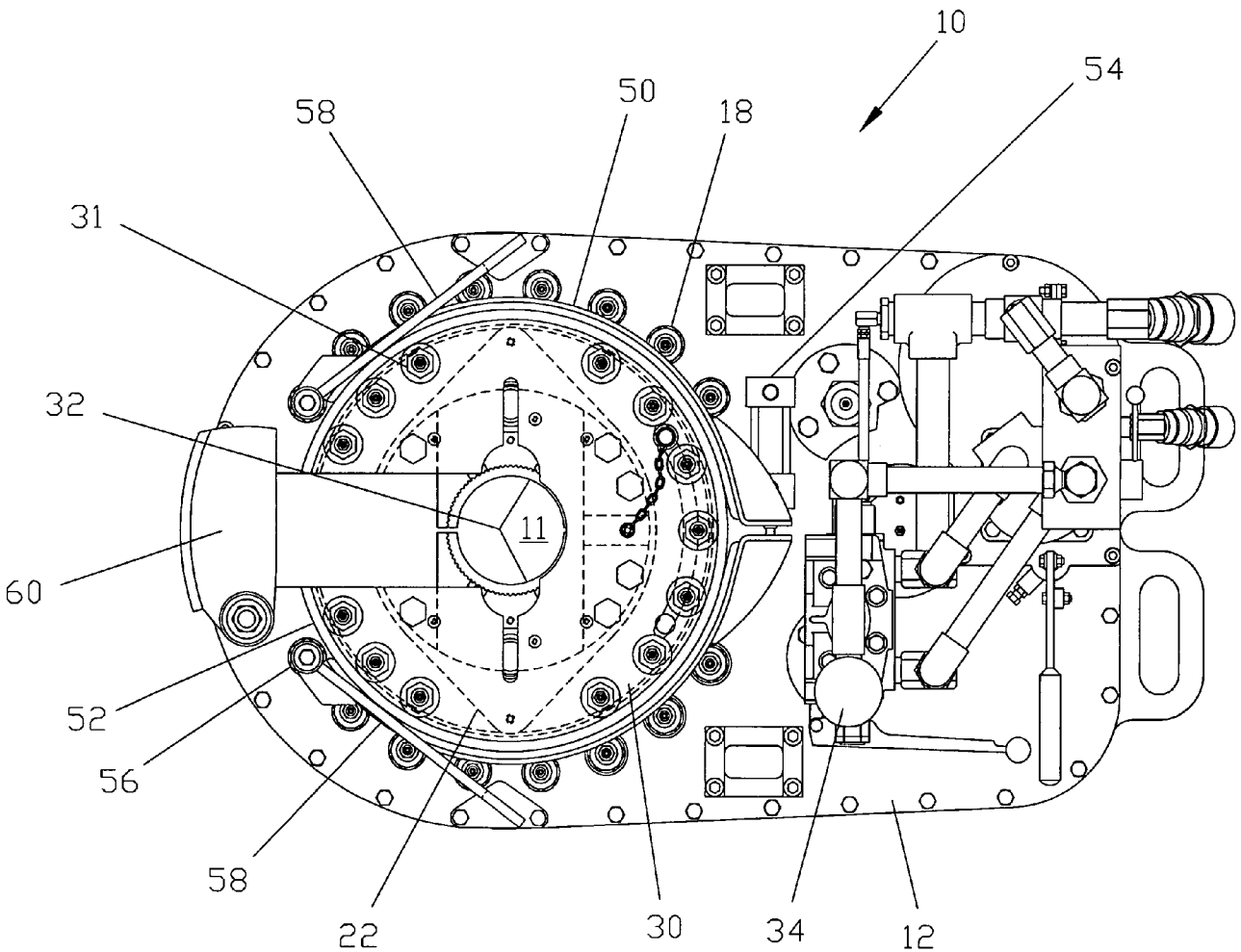
FIG. 1 is a top view of a power tong according to the present invention.
Figure 2:
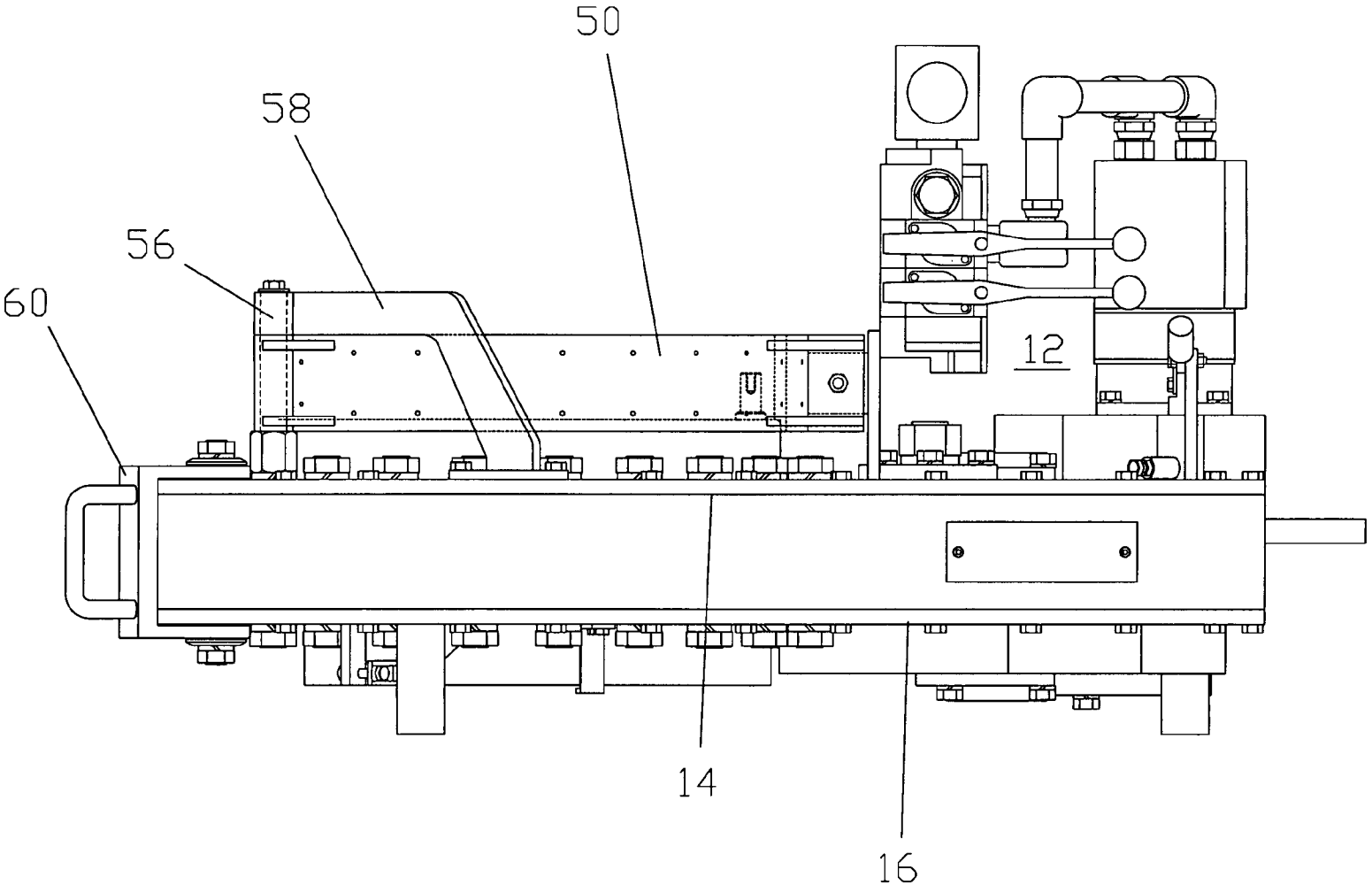
FIG. 2 is a side view of the power tong shown in FIG. 1.
Figure 3:
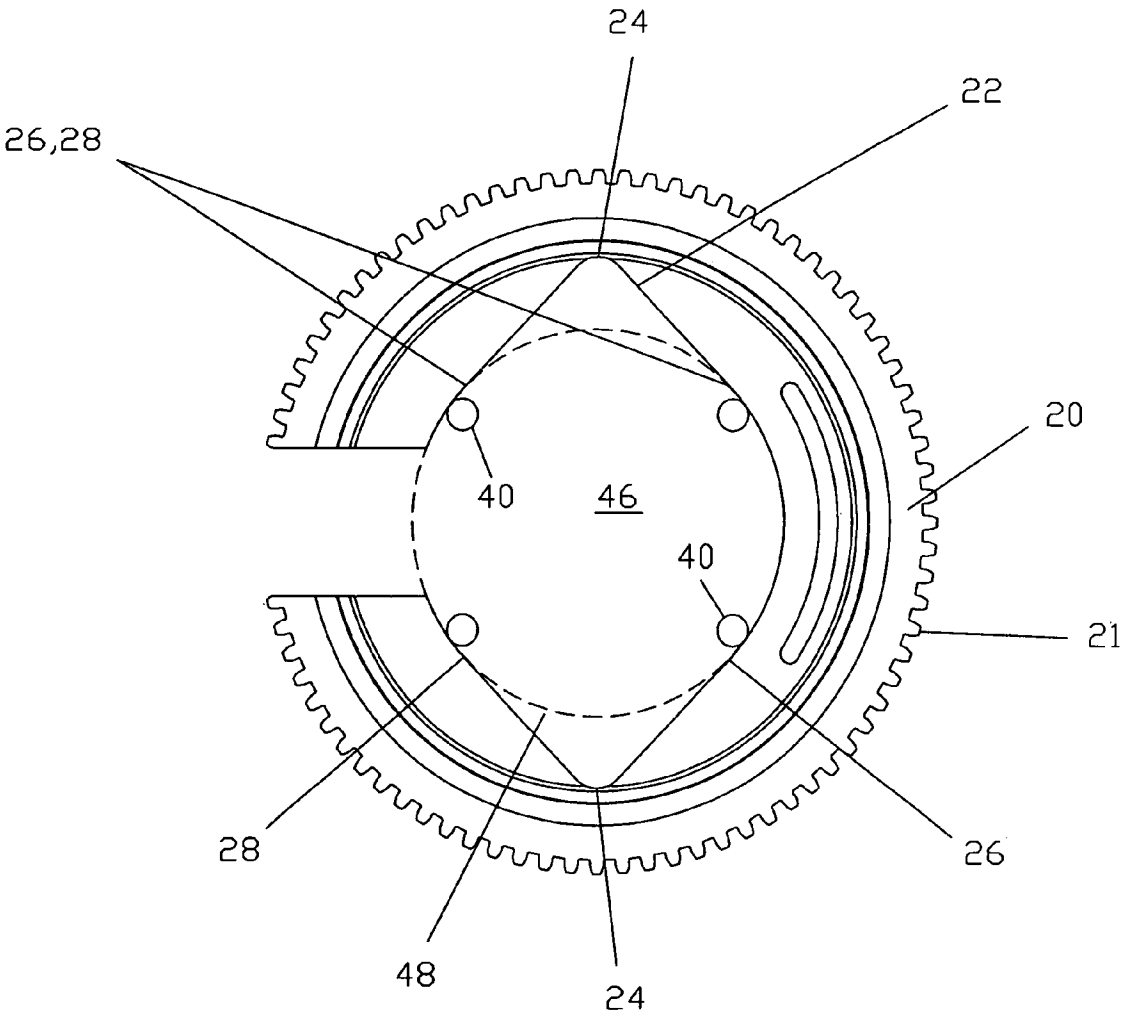
FIG. 3 is a top view of the partial ring gear for the power tong.
Figure 4:
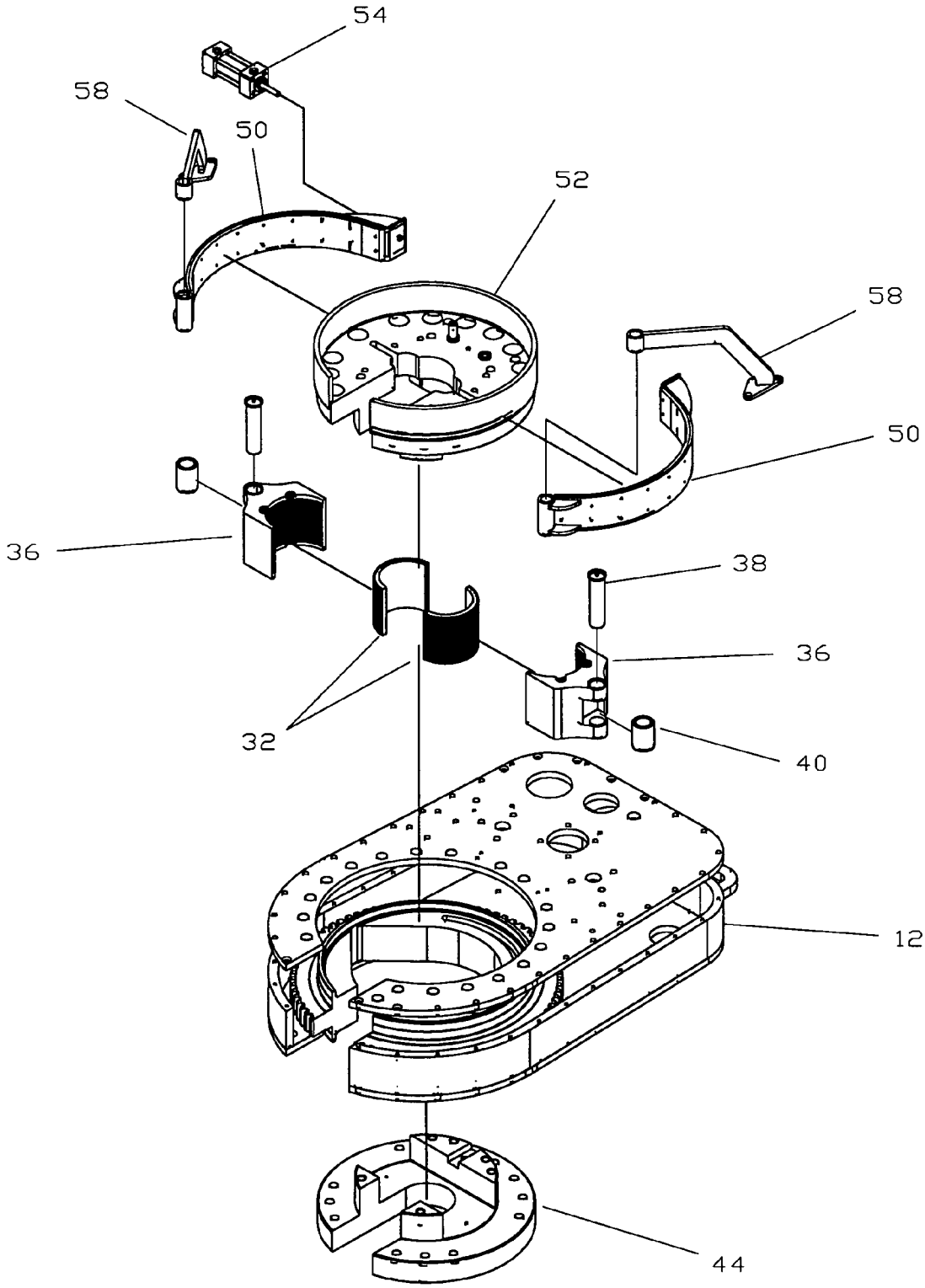
FIG. 4 is an exploded view of a portion of the power tong.

FIG. 1 discloses a power tong 10 having a tong frame 12 including upper and lower tong plates 14, 16, shown in FIG. 2. The power tong 10 has a central opening 11 for receiving the tubular to be rotated. A geared ring 20 as shown in FIG. 3 is supported between the tong plates on circumferentially arranged roller bearings 18, as shown in FIG. 1. Ring 20 includes a pair of interior cam surfaces 22, which each comprise a neutral cam portion 24, a makeup cam portion 26 and a breakout cam portion 28. A cage plate assembly 30 is rotatably mounted with the ring 20, and rotates on cage plate bearings 31. The cage plate assembly includes an upper cage plate 42 and a lower cage plate 44 as shown in FIG. 4. A pair of dies 32 supported on the cage plate assembly are adapted to move radially inward and outward in response to engagement with the cam surfaces to engage and disengage the tubular. A conventional drive mechanism 34 including hydraulic motors and gearing engage the outer teeth 21 of the ring 20 to rotate the ring during the makeup or breakout operation. FIGS. 1 and 2 also depict a conventional door 60 which is closed to cover the open throat of the power tong when the ring member and cage plate are rotated.

The dies as shown in FIG. 1 preferably are formed from aluminum and include a knurled surface for engagement with the tubular. Knurling on a dies preferentially has a knurled depth (depth of knurling to face surface of dies) of about 0.010 inches, and preferentially less than about 0.015 inches. The dies preferentially wrap substantially entirely around the oilfield tubular, and each of the dies as shown in FIG. 1 have a circumferential length of at least 100°, and preferably at least 170°, for engagement with the tubular. Referring to FIG. 4, the aluminum dies 32 are each mounted on a respective die head 36. A pin 38 secures a cam roller 40 to the die head, and the roller 40 is the member that rides up the cam surface during the makeup and breakout operations.

Referring again to FIG. 3, the location where a die roller 40 resides on the cam surface when the dies first engage the pipe during a makeup or breakout operation is depicted with the die rollers 40. Two die rollers thus engage the makeup surface during the makeup operation, and the same two dies engage the breakout surface during the breakout operation. Preferentially, this cam surface has a cam angle, i.e., the angle between the center 41 of the ring 20 and the center of the cam surface at the location of the roller when the die first engages the tubular, which is less than about ¾°, and preferably about ½°. Further detail with respect to the calculations of the cam angle is provided in U.S. Pat. No. 4,084,453, hereby incorporated by reference. This very small cam angle provides substantially increased gripping of the aluminum die with the tubular. Due to the circumferential length of the dies, the cam surface is provided with a radially deep or radially outward neutral cam portion, as shown in FIG. 3. This neutral cam is at least approximately 25% radially outward, and typically from 25% to about 30% radially outward, of an imaginary circle 48 which includes the inner points of the throat of the ring gear 20, as shown in FIG. 3.

In order to achieve a high biting force of the dies with the tubular before rotation of the cage plate assembly, the tong 10 is provided with a robust brake band 50. As shown in FIG. 2, the brake band extends axially upward from the top plate 14 of the tong a substantial distance, typically in excess of four inches. More particularly, the axial height of the brake band 50 is at least 35% of a width of the open throat of the cage plate, and in many embodiments will be at least 40% of the width of the throat of the cage plate. As the size and the torque level of the power tong increase, both the powered brake band and the engaging plate secured to the cage plate assembly may be provided both above and below the cage plate assembly, rather than merely above the cage plate assembly. An arcuate plate 52 is secured to the cage plate assembly 30 and is positioned radially within the brake band, which similarly extends upward to provide a frictional surface for engagement with the brake band. Increased force between the cage plate assembly and the brake band is provided by the fluid powered cylinder 54 which acts to pull the brake band halves together during the initial grip of the heads with the tubular. The brake band cylinder is preferably hydraulically powered, but alternately could be pneumatically powered or powered by a small motor and gear mechanism.

According to one embodiment, the tong operator notices initial rotation of the cage plate assembly, and in response thereto releases the fluid pressure to a cylinder 54, thereby effectively releasing the brake band from high frictional engagement with the cage plate assembly. In another embodiment, a sensor may be used to sense initial rotation of the cage plate assembly, so that fluid pressure to the cylinder may be automatically released in response to the sensor. Those skilled in the art should appreciate that a substantially tall brake band 50 is preferably provided according to the present invention, so that the size of the fluid powered cylinder which pulls tension on the brake band to grip the cage plate assembly may be relatively compact and inexpensive. The size of the brake band could be decreased if the power supplied by the cylinder 54 were increased.

The pins 56 at the forward end of the brake band extend upward from the cage plate 14, and are each supported by the brake band support 58, which is a plate like member extending from the pin toward the edge of the tong plate, and is secured to the tong frame to support the pin 56.

Each of the tong frame 12, the partial ring gear 20 and the cage plate assembly 30 as shown in FIG. 1 have an open throat so that the tong can be moved laterally on and off the tubular during a makeup operation. The concepts of the present invention are also applicable, however, to a closed throat tong in which the tong plate, gear ring and cage plate assembly are continuous with no open throat portion.

The foregoing disclosure and description of the invention is illustrative and explanatory of preferred embodiments. It would be appreciated by those skilled in the art that various changes in the size, shape of material, as well as in the details of the illustrated construction or combination of features discussed herein may be made without departing from the spirit of the invention, which is defined by the following claims.

What is claimed:

1. A power tong for rotating a tubular to makeup or breakout a threaded connection, comprising:

a tong frame having a central opening for receiving the tubular, an upper frame plate, and a lower frame plate;

a ring rotatably mounted on the frame about a center of rotation, the ring defining a pair of cam surfaces on an interior surface of the ring, each cam surface having a neutral cam portion, a makeup cam portion and a breakout cam portion, the pair of cam surfaces being spaced on the ring circumferentially approximately 180° apart;

a cage plate assembly rotatable within the ring;

a plurality of dies supported on the cage plate and adapted to move radially to engage and disengage the tubular in response to movement of the dies along the cam surfaces;

an arcuate brake band spaced opposite the lower frame plate with respect to the upper frame plate for frictional engagement with the cage plate assembly;

an arcuate plate fixed to the cage plate and extending upward from the cage plate for engagement with the brake band;

a fluid powered cylinder for tensioning the brake band to selectively increase frictional forces between the brake band and the cage plate assembly;

a drive mechanism for rotating the ring, the cage plate assembly and the dies to rotate the tubular; and the neutral cam portion of each cam surface is spaced radially outward from an imaginary circle intersecting radially inward edges of the throat of the cage plate by a spacing of at least 25% of the imaginary circle diameter.

2. A power tong as defined in claim 1, wherein each of the tong frame, the ring and the cage plate assembly have an open throat for moving the tubular laterally into and out of the central opening.

3. A power tong as defined in claim 1, wherein the dies are formed from aluminum and have a knurled surface.

4. A power tong as defined in claim 2, wherein the plurality of dies comprise two dies, and each die engages the tubular over circumferential length of at least 170°.

5. A power tong as defined in claim 1, wherein each of the makeup cam portion and breakout cam portion of the ring have a cam angle of less than about ¾°.

6. A power tong as defined in claim 2, further comprising:

a pin for supporting an end of the brake band adjacent the open throat of the cage plate assembly;

a metal bracket secured to the tong frame for supporting the pin.

7. A power tong for rotating a tubular to makeup or breakout a threaded connection, comprising:

a tong frame having an open throat and central opening for receiving the tubular;

a partial ring having an open throat and rotatably mounted on the frame about a center of rotation, the ring defining a pair of cam surfaces on an interior surface of the ring, each cam surface having a neutral cam portion, a makeup cam portion and a breakout cam portion, the pair of cam surfaces being spaced on the ring circumferentially approximately 180° apart;

a cage plate assembly having an open throat and rotatable within the partial ring;

a pair of dies supported on the cage plate and adapted to move radially to engage and disengage the tubular in response to movement of the dies along the cam surfaces;

an arcuate brake band for frictional engagement with the cage plate assembly;

the neutral cam portion of each cam surface is spaced radially outward from an imaginary circle intersecting radially inward edges of the throat of the cage plate by a spacing of at least 25% of the imaginary circle diameter; and a drive mechanism for rotating the ring, the cage plate assembly and the dies to rotate the tubular.

8. A power tong as defined in claim 7, wherein the dies are formed from aluminum and have a knurled surface with a knurled depth of less than 0.015 inches.

9. A power tong as defined in claim 7, wherein the pair of dies each engages the tubular over circumferential length of at least 170°.

10. A power tong as defined in claim 7, wherein each of the makeup cam portion and breakout cam portion of the ring have a cam angle of less than about ¾°.

11. A power tong for rotating a tubular to makeup or breakout a threaded connection, comprising:

a tong frame having an open throat and central opening for receiving the tubular;

a partial ring having an open throat and rotatably mounted on the frame about a center of rotation, the ring defining a pair of cam surfaces on an interior surface of the ring, each cam surface having a neutral cam portion, a makeup cam portion and a breakout cam portion, the pair of cam surfaces being spaced on the ring circumferentially approximately 180°apart;

a cage plate assembly having an open throat and rotatable within the partial ring;

each of the tong frame, the partial ring and the cage plate assembly have an open throat for moving the tubular laterally into and out of the central opening;

a pair of dies supported on the cage plate and adapted to move radially to engage and disengage the tubular in response to movement of the dies along the cam surfaces;

the neutral cam portion of the cam surface is spaced radially outward from an imaginary circle intersecting radially inward edges of the throat of the cage plate by a spacing of at least 25% of the imaginary circle diameter; and a drive mechanism for rotating the ring, the cage plate assembly and the dies to rotate the tubular.

12. A power tong as defined in claim 11, wherein the plurality of dies comprise two dies, and each die engages the tubular over circumferential length of at least 170°.

13. A power tong as defined in claim 11, wherein each of the makeup cam portion and breakout cam portion of the ring have a cam angle of less than about ¾°.

14. A power tong as defined in claim 11, wherein the dies are formed from aluminum and have a knurled surface, and has a knurled depth of less than 0.015 inches.

* * * * *